US010376068B2

(12) United States Patent
Hong et al.

(10) Patent No.: US 10,376,068 B2
(45) Date of Patent: Aug. 13, 2019

(54) SEAT CUSHION

(71) Applicant: National Taiwan Normal University, Taipei (TW)

(72) Inventors: Jon-Chao Hong, Taipei (TW); Mei-Yung Chen, Taipei (TW); Kai-Wen Tai, Taipei (TW); Kai-Hsin Tai, Taipei (TW); Chi-Ruei Tsai, Taipei (TW)

(73) Assignee: NATIONAL TAIWAN NORMAL UNIVERSITY, Taipei (TW)

( * ) Notice: Subject to any disclaimer, the term of this patent is extended or adjusted under 35 U.S.C. 154(b) by 43 days.

(21) Appl. No.: 15/581,610

(22) Filed: Apr. 28, 2017

(65) Prior Publication Data

US 2018/0310713 A1 Nov. 1, 2018

(51) Int. Cl.

| | |
|---|---|
| ***A47C 1/00*** | (2006.01) |
| ***A47C 1/02*** | (2006.01) |
| ***A47C 7/62*** | (2006.01) |
| ***A47C 7/14*** | (2006.01) |

(52) U.S. Cl.

CPC . *A47C 7/62* (2013.01); *A47C 7/14* (2013.01)

(58) Field of Classification Search

CPC .. B60N 2/02; B60N 2/002; A61G 5/14; A47C 7/02

USPC ..... 297/217.2, 313, 337

See application file for complete search history.

(56) References Cited

U.S. PATENT DOCUMENTS 4,944,554 A * 7/1990 Gross ..... A47C 7/462 297/284.3
7,850,240 B2 * 12/2010 Welles ..... A61B 5/11 297/217.2
7,976,060 B2 * 7/2011 Breed ..... B60N 2/002 180/273
9,814,637 B2 * 11/2017 Sazonov ..... A61B 5/6894
2010/0207434 A1 * 8/2010 Kurrasch ..... A47C 1/0242 297/217.2
2013/0012786 A1 * 1/2013 Horseman ..... G06F 19/3418 600/301

(Continued)

FOREIGN PATENT DOCUMENTS

| | | |
|---|---|---|
| CN | 104013229 A | 9/2014 |
| TW | 201200074 A1 | 1/2012 |
| TW | M512970 U | 12/2015 |

OTHER PUBLICATIONS

Taiwanese Search Report, dated May 1, 2018, for Taiwanese Application No. 106116946, with an English translation.

*Primary Examiner* — Shin H Kim

(74) *Attorney, Agent, or Firm* — Birch, Stewart, Kolasch & Birch, LLP

(57) ABSTRACT

A seat cushion includes a cushion body, a weight measuring unit coupled to the cushion body, a tilt adjusting unit, a storage unit storing pre-established mapping data, and a controlling unit. The weight measuring unit measures, when a user is sitting on the cushion body, weight of the user applied to the cushion body so as to generate a result of weight measurement. The controlling unit is connected to the weight measuring unit, the tilt adjusting unit and the storage unit, and controls, when the seat cushion is operated in an automatic mode, the tilt adjusting unit to adjust a seat angle of the cushion body with respect to a horizontal reference plane based on the result of weight measurement, a height value and the mapping data.

6 Claims, 3 Drawing Sheets

(56) References Cited

U.S. PATENT DOCUMENTS

| | | | | |
|---|---|---|---|---|
| 2013/0069402 | A1* | 3/2013 | Kang | B60N 2/002 297/217.2 |
| 2015/0210192 | A1* | 7/2015 | Benson | B60N 2/914 297/217.2 |
| 2015/0351981 | A1* | 12/2015 | Sazonov | A61B 5/6894 297/217.2 |
| 2016/0159254 | A1* | 6/2016 | Katoh | A47C 1/024 297/313 |
| 2016/0374879 | A1* | 12/2016 | Christian | A61G 5/14 297/313 |
| 2018/0125416 | A1* | 5/2018 | Schwarz | A61B 5/486 |

* cited by examiner

SEAT CUSHION

FIELD

The disclosure relates to a seat cushion, and more particularly to a seat cushion capable of automatically adjusting a sitting angle.

BACKGROUND

A correct sitting posture is crucial for the health of the sitter. Therefore, people having different body shapes usually require distinct chair geometry. However, manually adjusting the chair geometry, such as an angle between a seat and a backrest, is troublesome especially when the same chair is to be sat by multiple persons.

SUMMARY

Therefore, an object of the disclosure is to provide a seat cash ion that can alleviate at least one of the drawbacks of the prior art, and that is capable of automatically adjusting a seat angle thereof based on different body features, e.g., weight and height.

According to the disclosure, the seat cushion includes a cushion body on which a user is to sit, a weight measuring unit, a tilt adjusting unit, a storage unit and a controlling unit.

The weight treasuring unit is coupled to the cushion body, and is configured to measure, when the user is sitting on the cushion body, weight of the user applied to the cushion body so as to generate a result of weight measurement.

The tilt adjusting unit is configured to adjust a seat angle of the cushion body with respect to a horizontal reference plane.

The storage unit is configured to store pre-established mapping data associated with seat angles, and heights and weights of users of the seat cushion.

The controlling unit is electrically connected to the weight measuring unit, the tilt adjusting unit and the storage unit. The controlling unit is configured to control, when the seat cushion is operated in an automatic mode, the tilt adjusting unit to adjust the seat angle of the cushion body based on the result of weight measurement, a height value that is obtained in advance by the controlling unit and that is associated with a height of the user, and the mapping data.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
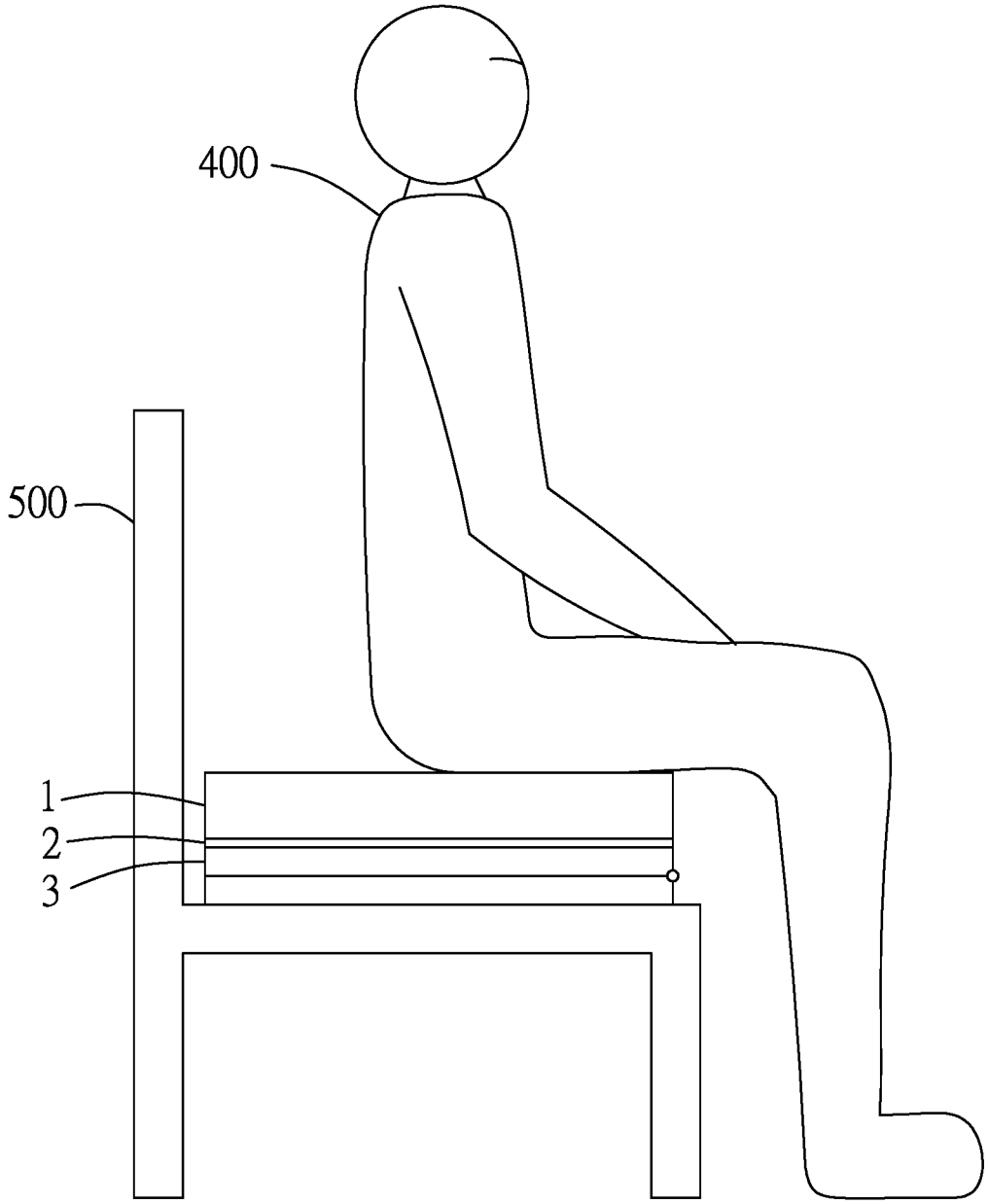
FIG. 1 is a schematic diagram illustrating an embodiment of a seat cushion according to the disclosure.
Figure 2:
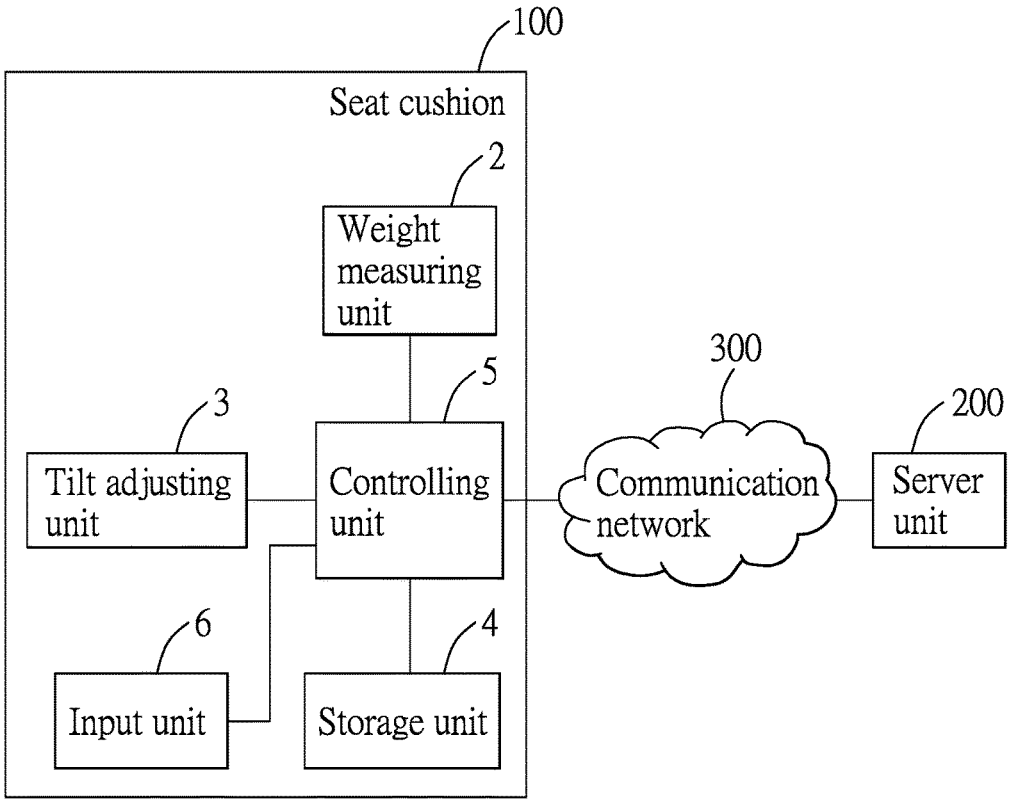
FIG. 2 is a schematic view illustrating components of the seat cushion according to the disclosure and a server unit with which the seat cushion is communicable.

Referring to FIGS. 1 and 2, an embodiment of a seat cushion 100 according to the disclosure is illustrated. The seat cushion 100 is adapted to be disposed on a chair 500, but is not limited thereto. The seat cushion 100 includes a cushion body 1 on which a user 400 is to sit, a weight measuring unit 2 coupled to the cushion body 1, a tilt adjusting unit 3, a storage unit 4, an input unit 6, and a can trolling unit 5 electrically connected to the weight measuring unit 2, the tilt adjusting unit 3, the storage unit 4 and the input unit 6. Moreover, the seat cushion 100 is communicable with a server unit 200 that is signally connected to the controlling unit 5 via a communication network 300.

In this embodiment, the cushion body 1 may be made of a foam material, but is not limited thereto.

In this embodiment, the input unit 6 may include a touch panel, but is not limited thereto.

The weight measuring unit 2 is configured to measure, when the user 400 is sitting on the cushion body 1, weight of the user 400 applied to the cushion body 1 so as to generate a result of weight measurement. The weight measuring unit 2 may be disposed between the cushion body 1 and the tilt adjusting unit 3, but is not limited thereto. In addition, the weight measuring unit 2 may be implemented by a weight scale, but is not limited thereto.

Figure 3:
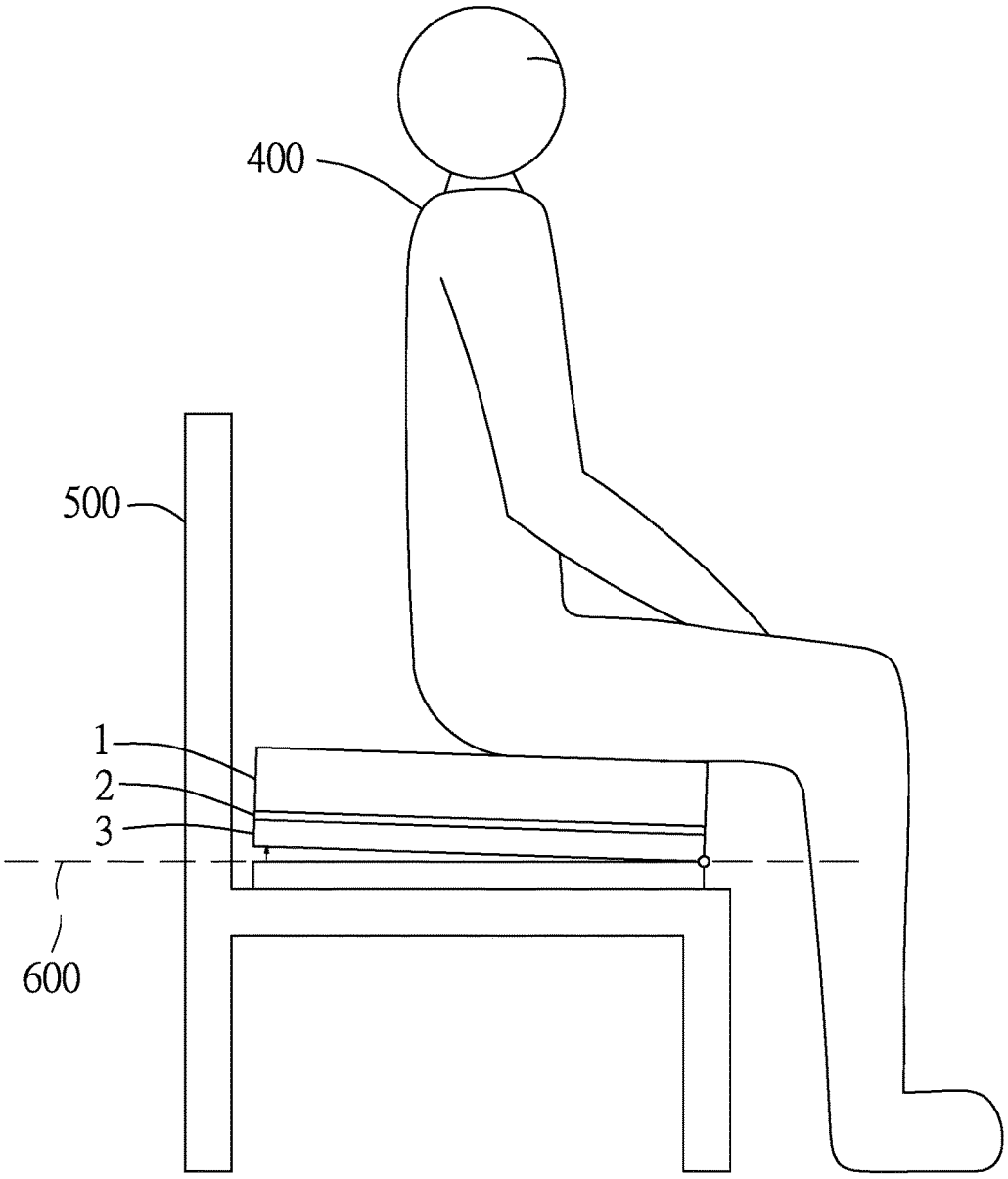
FIG. 3 is a schematic diagram illustrating a seat angle adjusted by the embodiment of the seat cushion.

Referring to FIG. 3, the tilt adjusting unit 3 is configured to adjust a seat angle of the cushion body 1 with respect to a horizontal reference plane 600. The tilt adjusting unit 3 may be implemented by an upper frame (not shown) which is pivotally connected to a lower frame (not shown) such that the upper frame is pivotally rotatable with respect to the lower frame. The cushion body 1 and the weight measuring unit 2 are disposed on the upper frame. The lower frame is disposed on the chair 500. Moreover, the tilt adjusting unit 3 may be implemented to further include a motor for driving the upper frame to pivotally rotate with respect to the lower frame so as to adjust the seat angle of the cushion body 1. It should be noted that implementation of the tilt adjusting unit 3 may vary in other embodiments, and is not limited to what are described herein.

The storage unit 4 is configured to store pre-established mapping data associated with seat angles, and heights, weights, genders and ages of users of the seat cushion 100.

The seat cushion 100 can be operated to switch between an automatic mode and a manual mode.

When the seat cushion 100 is operated in the automatic mode, the controlling unit 5 is configured to control the tilt adjusting unit 3 to adjust the seat angle of the cushion body 1 based on the result of weight measurement, a height value that is obtained in advance by the controlling unit 5 and that is associated with a height of the user 400, gender information that is obtained in advance by the controlling unit 5 and that is associated with a gender of the user 400, an age information that is obtained in advance by the controlling unit 5 and that is associated with an age of the user 400, and the mapping data. In this embodiment, the height value, the gender information and the age information are inputted by the user 400 via the input unit 6, but are not limited thereto.

Specifically speaking, when the seat cushion 100 is operated in the automatic mode, the controlling unit 5 is further configured to determine an index of weight-for-height of the user according to the result of weight measurement and the height value. In this embodiment, the index of weight-for-height is the body mass index (BMI) which is calculated by dividing the result of weight measurement by a square of the height value, but is not limited thereto. In other words, given that the result of weight measurement is w, and that the height value is h, the BMI can be determined by $$BMI = \frac{w}{h^2}.$$

Consequently, the controlling unit 5 is configured to control, when the seat cushion 100 is operated in the automatic mode, the tilt adjusting unit 3 to adjust the seat angle of the cushion body 1 based on the BMI, the gender information, the age information and the mapping data.

When the seat cushion 100 is operated in the manual mode, the controlling unit 5 is configured to control the tilt adjusting unit 3 to adjust the seat angle of the cushion body 1 based on a desired angle value for the seat cushion 100 that is associated with a desired seat angle of the cushion body 1 with respect to the horizontal reference plane 600 and that is inputted by the user 400 via the input unit 6. The controlling unit 5 is further configured to transmit the desired angle value thus inputted, the BMI, the gender information and the age information which may be obtained in a similar manner as in the automatic mode to the server unit 200 via the communication network 300.

The desired angle value, the BMI, the gender information and the age information which are transmitted to the server unit 200 enable the server unit 200 to store the same as an entry of angle record, to update, every predetermined time period, the mapping data according to at least the entry of angle record, and to transmit the mapping data back to the controlling unit 5 of the seat cushion 100. After receiving the mapping data from the server unit 200, the controlling unit 5 is configured to replace the mapping data (originally) stored in the storage unit 4 with the mapping data received from the server unit 200. In other words, the seat cushion 100 of this disclosure is capable of collecting the desired angle values, the BMIs, the gender information and the age information from different users so as to form big data, and performing an operation associated with statistical techniques, such as artificial neural network (ANN), on the big data to generate the mapping data.

It is worth noting that the input unit 6 is included in the seat cushion 100 in one embodiment, but the input unit 6 may not be included in the seat cushion 100 in other embodiments. For example, the seat cushion 100 may obtain inputs from the user 400 via an electronic device such as a smart phone which is communicably coupled to the seat cushion 100.

However, in one embodiment, the seat cushion 100 is removably disposed on and may be separated from, the chair 500, but in other embodiments, the seat cushion 100 may foe integrated with the chair 500 as one piece.

In summary, the seat cushion 100 is capable of measuring, via the weight measuring unit 2, the weight of the user 400 applied to the cushion body 1 so as to generate a result of weight measurement, end adjusting, via the tilt adjusting unit 3, the seat angle of the cushion body 1 based at least on the result of weight measurement, the height value and the mapping data. In consequence, the seat cushion 100 of this disclosure is capable of automatically adjusting the seat angle of the cushion body 1 suitable for the user 400 without requiring manual settings from the user 400, so as to promote convenience in using the same.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may foe included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A seat cushion comprising a cushion body on which a user is to sit;

a weight measuring unit coupled to said cushion body, and configured to measure, when the user is sitting on said cushion body, weight of the user applied to said cushion body so as to generate a result of weight measurement;

a tilt adjusting unit configured to adjust a seat angle of said cushion body with respect to a horizontal reference plane;

a storage unit configured to store pre-established mapping data associated with seat angles, and heights and weights of users of the seat cushion; and a controlling unit electrically connected to said weight measuring unit, said tilt adjusting unit and said storage unit, and configured to control, when said seat cushion is operated in an automatic mode, said tilt adjusting unit to adjust the seat angle of said cushion body based on the result of weight measurement, a height value that is obtained in advance by said controlling unit and that is associated with a height of the user, and the mapping data.

2. The seat cushion as claimed in claim 1, wherein when said seat cushion is operated in the automatic mode, said controlling unit is further configured to determine an index of weight-for-height of the user according to the result of weight measurement and the height value, and to control said tilt adjusting unit to adjust the seat angle of said cushion body based on the index of weight-for-height and the mapping data.

3. The seat cushion as claimed in claim 2, wherein the index of weight-for-height is the body mass index (BMI) which is calculated by dividing the result of weight measurement by a square of the height value.

4. The seat cushion as claimed in claim 3, wherein when said seat cushion is operated in the automatic mode, said controlling unit is configured to control said tilt adjusting unit to adjust the seat angle of said cushion body based on the BMI, the mapping data which is further associated with genders of the users, and gender information that is obtained in advance by said controlling unit and that is associated with a gender of the user.

5. The seat cushion as claimed in claim 4, wherein when said seat cushion is operated in the automatic mode, said controlling unit is configured to control said tilt adjusting unit to adjust the seat angle of said cushion body based on the BMI, the gender information, the mapping data which is further associated with ages of the users, and an age information that is obtained in advance by said controlling unit and that is associated with an age of the user.

6. The seat cushion as claimed in claim 5, further comprising an input unit electrically connected to said controlling unit, said seat cushion being communicable with a server unit that is signally connected to said controlling unit via a communication network, wherein:

when said seat cushion is operated in a manual mode, said controlling unit is configured to control said tilt adjusting unit to adjust the seat angle of said cushion body based on a desired angle value for the seat cushion that is inputted by the user via said input unit, and to transmit the desired angle value, the BMI, the gender information and the age information to said server unit;

the desired angle value, the BMI, the gender information and the age information enable said server unit to store the same as an entry of angle record, to update the mapping data according to at least the entry of angle record, and to transmit the mapping data to said controlling unit; and after receiving the mapping data from the server unit, said controlling unit is configured to replace the mapping data stored in said storage unit with the mapping data received from said server unit.

* * * * *